US011489243B2

(12) United States Patent
Kim

(10) Patent No.: US 11,489,243 B2
(45) Date of Patent: Nov. 1, 2022

(54) DIRECTIONAL COUPLER

(71) Applicant: Murata Manufacturing Co., Ltd., Kyoto (JP)

(72) Inventor: Ryangsu Kim, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 46 days.

(21) Appl. No.: 16/850,655

(22) Filed: Apr. 16, 2020

(65) Prior Publication Data

US 2020/0335846 A1 Oct. 22, 2020

(30) Foreign Application Priority Data

Apr. 17, 2019 (JP) ..... JP2019-078594

(51) Int. Cl.

| | |
|---|---|
| ***H01P 5/12*** | (2006.01) |
| ***H01P 5/18*** | (2006.01) |
| ***H01P 1/20*** | (2006.01) |
| ***H01P 1/22*** | (2006.01) |
| ***H01P 1/24*** | (2006.01) |

(52) U.S. Cl.

CPC ..... *H01P 5/184* (2013.01); *H01P 1/20* (2013.01); *H01P 1/22* (2013.01); *H01P 1/24* (2013.01); *H01P 5/185* (2013.01)

(58) Field of Classification Search

CPC .. H01P 5/184; H01P 5/185; H01P 5/12; H01P 5/186; H01P 5/16; H01P 5/18

See application file for complete search history.

(56) References Cited

FOREIGN PATENT DOCUMENTS

| | | | |
|---|---|---|---|
| JP | H07-336117 | A | 12/1995 |
| JP | 2006-238063 | A | 9/2006 |
| JP | 2015-162729 | A | 9/2015 |

OTHER PUBLICATIONS

JPH07336117A Translation (Year: 1995).*

* cited by examiner

*Primary Examiner* — Stephen E. Jones
(74) *Attorney, Agent, or Firm* — Pearne & Gordon LLP

(57) ABSTRACT

A dielectric having a first main surface and a second main surface facing each other, a main line provided on a side of the first main surface in contact with the dielectric, and a sub line provided on the side of the first main surface in contact with the dielectric are included, the dielectric has a first portion in contact with the main line and a second portion in contact with the sub line, and when the first main surface is viewed in a plan view, between the first portion and the second portion, a third portion having a relative dielectric constant changing along a direction intersecting with the main line and the sub line is located.

14 Claims, 6 Drawing Sheets

DIRECTIONAL COUPLER

This application claims priority from Japanese Patent Application No. 2019-078594 filed on Apr. 17, 2019. The content of this application is incorporated herein by reference in its entirety.

BACKGROUND OF THE DISCLOSURE

1. Field of the Disclosure

The present disclosure relates to a directional coupler.

2. Description of the Related Art

A directional coupler is a basic element widely used in wireless equipment such as a portable terminal device or the like. For example, Japanese Unexamined Patent Application Publication No. 2006-238063 discloses a directional coupler in which a main line and a sub line are provided on a dielectric substrate with an interval therebetween and so as to be at least partially parallel to each other.

A degree of coupling and directivity of the directional coupler can be adjusted, for example, by changing the distance between the main line and the sub line and the width of each line. However, when the distance between the main line and the sub line and the width of each line are changed, characteristics, such as impedance or the like of the main line and the sub line, other than the degree of coupling and directivity are also influenced. Therefore, due to the need to suppress the influence, the degree of coupling and directivity each cannot completely be adjusted to a desired value in some cases. In other words, there are cases where the degree of freedom in the adjustment of the degree of coupling and directivity is limited.

BRIEF SUMMARY OF THE DISCLOSURE

Accordingly, it is an object of the present disclosure to provide a directional coupler in which a degree of coupling and directivity can be more precisely adjusted.

In order to achieve the above-described object, according to preferred embodiments of the present disclosure, a directional coupler includes: a dielectric having a first main surface and a second main surface facing each other; a main line provided on a side of the first main surface in contact with the dielectric; and a sub line provided on the side of the first main surface in contact with the dielectric, in which the dielectric has a first portion in contact with the main line and a second portion in contact with the sub line, and when the first main surface is viewed in a plan view, between the first portion and the second portion, a third portion having a relative dielectric constant changing along a direction intersecting with the main line and the sub line is located.

Other features, elements, characteristics and advantages of the present disclosure will become more apparent from the following detailed description of preferred embodiments of the present disclosure with reference to the attached drawings.

DETAILED DESCRIPTION OF THE DISCLOSURE

A plurality of embodiments of the present disclosure will be described in detail with reference to the drawings. Note that all embodiments described below indicate comprehensive or specific examples. Numerical values, shapes, materials, constituent elements, arrangement and connection forms of the constituent elements, and the like, which will be described in the following embodiments, are examples, and are not intended to limit the present disclosure.

First Embodiment

A directional coupler according to a first embodiment will be described.

Figure 1A:
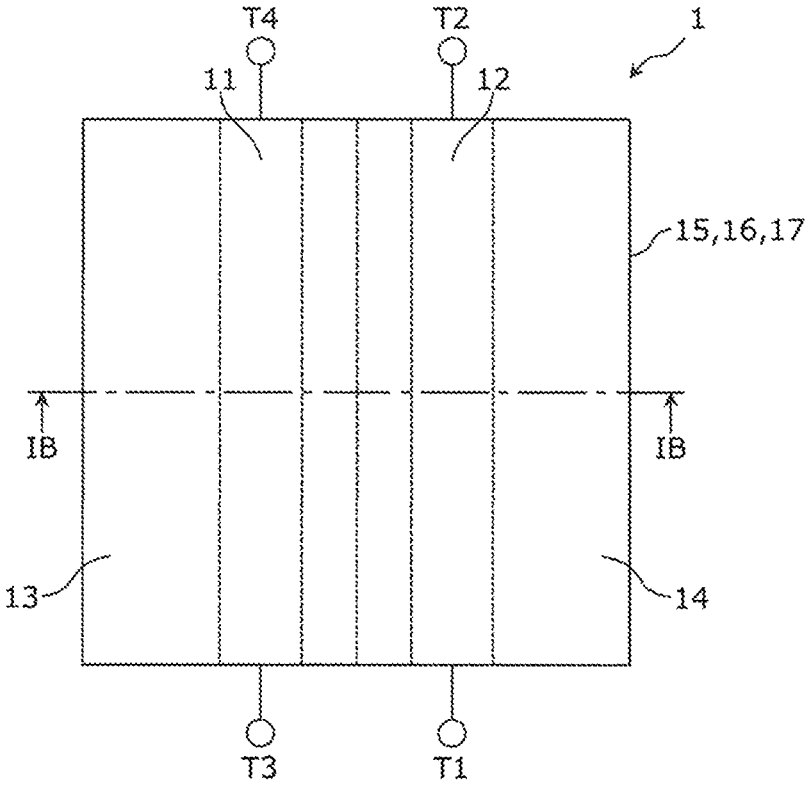
FIG. 1A is a top view illustrating an example of a structure of a directional coupler according to a first embodiment.
Figure 1B:
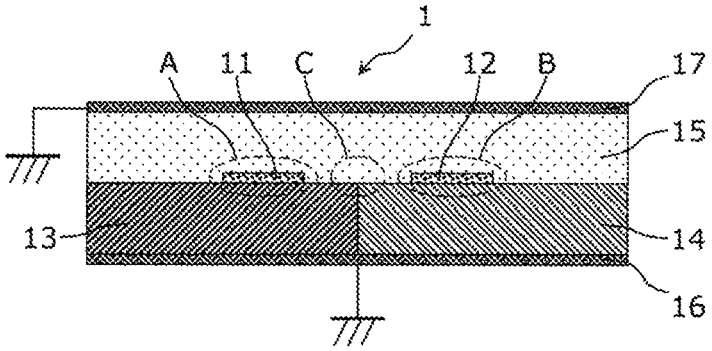
FIG. 1B is a side view illustrating the example of the structure of the directional coupler according to the first embodiment.

FIG. 1A and FIG. 1B are a top view and a side view, respectively, illustrating an example of a structure of the directional coupler according to the first embodiment. FIG. 1B corresponds to a cross section indicated by the IB-IB line in FIG. 1A.

As illustrated in FIG. 1A and FIG. 1B, a directional coupler 1 is constituted of a main line 11, a sub line 12, dielectrics 13, 14, and 15, and ground electrodes 16 and 17.

The dielectrics 13 and 14 each have a main surface on the ground electrode 16 side and a main surface on the ground electrode 17 side. Here, in each of the dielectrics 13 and 14, the main surface on the ground electrode 17 side is an example of a "first main surface", and the main surface on the ground electrode 16 side is an example of a "second main surface".

The main line 11 is formed on the main surface of the dielectric 13 on the ground electrode 17 side, the sub line 12 is formed on the main surface of the dielectric 14 on the ground electrode 17 side, and the main line 11 and the sub line 12 are electromagnetically coupled to each other. That is, when the dielectrics 13 and 14 are considered as one dielectric, both the main line 11 and the sub line 12 are provided in contact with the one dielectric on the first main surface side of the one dielectric. The main line 11 and the sub line 12 may be formed on the same surface. The main line 11, the sub line 12, and the dielectrics 13 and 14 are covered by the dielectric 15. The dielectrics 13, 14, and 15 are sandwiched between the ground electrodes 16 and 17.

The main line 11 and the sub line 12 are electromagnetically coupled to each other.

With this configuration, a part of a main signal in a forward direction which is a main signal propagating in the main line 11 from a first end portion T3 to a second end portion T4 is outputted from a first end portion T1 of the sub line 12 as a detection signal in the forward direction in a state where a second end portion T2 of the sub line 12 is terminated.

Furthermore, a part of a main signal in a reverse direction which is a main signal propagating in the main line 11 from the second end portion T4 to the first end portion T3 is outputted from the second end portion T2 of the sub line 12 as a detection signal in the reverse direction in a state where the first end portion T1 of the sub line 12 is terminated.

That is, when the detection signal for the main signal in the forward direction is obtained, the second end portion T2 of the sub line 12 is an end portion for termination, and the first end portion T1 is an end portion for signal output. Furthermore, when the detection signal for the main signal in the reverse direction is obtained, the first end portion T1 of the sub line 12 is an end portion for termination, and the second end portion T2 is an end portion for signal output.

Note that the definition of the forward direction and the reverse direction may be opposite to that described above.

In the directional coupler 1, a circuit connected to each of the first end portion T3 and the second end portion T4 of the main line 11 and the first end portion T1 and the second end portion T2 of the sub line 12 is not particularly limited.

As an example, the end portions T1 to T4 may be respectively connected to the corresponding external terminals (not illustrated). In other words, the directional coupler 1 may be configured as a four-terminal element. Furthermore, as will be described later, of the first end portion T1 and the second end portion T2 of the sub line 12, the end portion for termination may be terminated inside the directional coupler 1, and the end portion for signal output may be connected to a functional circuit provided inside the directional coupler 1.

When the aggregate of the dielectrics 13 and 14 is considered as one dielectric, the one dielectric has a first portion A which is in contact with the main line 11 and a second portion B which is in contact with the sub line 12. Additionally, the dielectric 15 has the first portion A which is in contact with the main line 11, and the second portion B which is in contact with the sub line. Here, when the directional coupler 1 is viewed in a plan view, between the first portion A and the second portion B, a third portion C is located in which a relative dielectric constant is changed along a direction intersecting with the main line 11 and the sub line 12.

Specifically, the relative dielectric constant of the dielectric 13 and the relative dielectric constant of the dielectric 14 are different from each other. The relative dielectric constant of the dielectric 15 may be equal to the relative dielectric constant of either one of the dielectrics 13 and 14, or different from both the relative dielectric constants of them. With this configuration, the relative dielectric constant in the third portion C is changed, toward the sub line 12 from the main line 11, from the relative dielectric constant in the first portion A to the relative dielectric constant in the second portion B.

In the directional coupler 1, the third portion C is a boundary point among material constants (that is, various physical property values correlated with the relative dielectric constants of the materials) of the dielectrics 13, 14, and 15, between the main line 11 and the sub line 12.

By adjusting the electric field distribution between the main line 11 and the sub line 12 in accordance with the position of the third portion C, the degree of coupling and directivity of the directional coupler 1 can be adjusted. In the adjustment of the degree of coupling and directivity, since the distance between the main line 11 and the sub line 12 and the width of each line are not changed, the influence on characteristics, such as the impedance or the like of the main line 11 and the sub line 12, other than the degree of coupling and directivity, is easily reduced in comparison with a case where the distance between the lines and the width of each line are changed.

Accordingly, since the degree of freedom in adjustment of coupling and directivity is improved, the degree of coupling and directivity can be adjusted more precisely. For characteristics other than the degree of coupling and directivity as well, by being independent of the adjustment of the degree of coupling and directivity to a certain degree, the degree of freedom in design for obtaining the desired characteristics is improved.

Furthermore, even when the distance between the main line 11 and the sub line 12 and the width of each line are changed, by further changing the position of the third portion C, it is possible to more precisely adjust the degree of coupling and directivity which have not been able to be completely adjusted only by changing the distance between the lines and the width of each line. This improves the degree of freedom in design for obtaining the desired characteristics.

Second Embodiment

A directional coupler according to a second embodiment will be described.

Figure 2A:
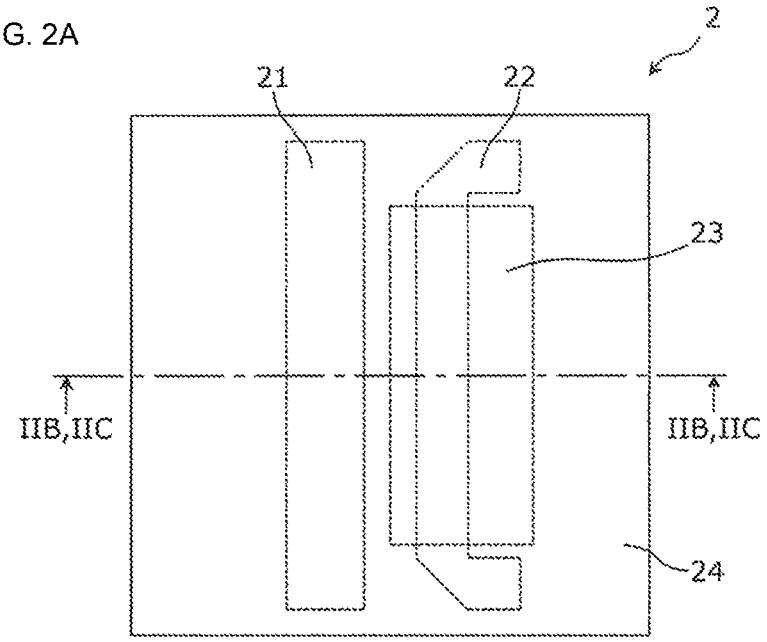
FIG. 2A is a top view illustrating an example of a structure of a directional coupler according to a second embodiment.

FIG. 2A is a top view illustrating an example of a structure of the directional coupler according to the second embodiment.

Figure 2B:
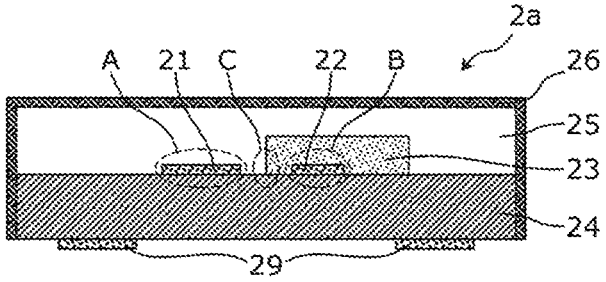
FIG. 2B is a side view illustrating a first example of the structure of the directional coupler according to the second embodiment.
Figure 2C:
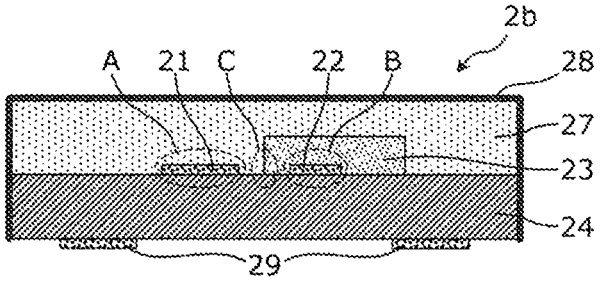
FIG. 2C is a side view illustrating a second example of the structure of the directional coupler according to the second embodiment.

FIG. 2B and FIG. 2C are side views illustrating a first example and a second example, respectively, of a structure of a directional coupler 2 illustrated in FIG. 2A. FIG. 2B and FIG. 2C correspond to cross sections indicated by the IIB, IIC-IIB, IIC line in FIG. 2A. In FIG. 2B and FIG. 2C, the directional coupler 2 is referred to as directional couplers 2*a* and 2*b*, respectively.

As illustrated in FIG. 2A, FIG. 2B, and FIG. 2C, the directional coupler 2 includes a dielectric substrate 24 on which a main line 21 and a sub line 22 are formed, and a dielectric layer 23 arranged on the dielectric substrate 24 and covering only the sub line 22 among the main line 21 and the sub line 22.

The dielectric substrate 24 is, for example, an external terminal substrate constituted of a printed wiring board for high frequency. External connection terminals 29 are provided on a main surface of the dielectric substrate 24 on the opposite side to a main surface on which the main line 21 and the sub line 22 are formed. Here, the main surface on which the main line 21 and the sub line 22 are formed in the dielectric substrate 24 is an example of a "first main surface", and the main surface on which the external connection terminals 29 are formed in the dielectric substrate 24 is an example of a "second main surface". That is, both of the main line 21 and the sub line 22 are provided in contact with the dielectric substrate 24 on the first main surface side of the dielectric substrate 24. Note that the main line 21 and the sub line 22 do not necessarily have to be in contact with the dielectric substrate 24. For example, in at least one space of the spaces between the dielectric substrate 24 and the main line 21 and between the dielectric substrate 24 and the sub line 22, another film or layer may be provided.

Note that the dielectric substrate 24 may be a multilayer body in which one or more dielectric layers are laminated on various substrates such as a semiconductor substrate or the like. When the dielectric substrate 24 is a multilayer body in which a plurality of dielectric layers is laminated on a semiconductor substrate, among the plurality of dielectric layers, a main surface on which the main line 21 and the sub line 22 are formed is taken as a "first main surface", and a main surface which faces the "first main surface" and is farthest from the "first main surface" of main surfaces of the semiconductor substrate is taken as a "second main surface".

The dielectric layer 23 is formed of, for example, a polyimide-based photosensitive resin. By being formed of the photosensitive resin, patterning of the dielectric layer 23 can be carried out with high accuracy by photolithography. Note that the dielectric layer 23 is not limited to being formed of a photosensitive resin, and may be formed of, for example, a resin ink which makes it possible to perform ink jet printing. A dielectric filler may be added to the photosensitive resin and the resin ink.

The directional coupler 2*a* illustrated in FIG. 2B further includes a metal cap 26 which covers the dielectric substrate 24 and forms a space 25 for housing the main line 21, the sub line 22, and the dielectric layer 23. The main line 21 is exposed to the space 25. The directional coupler 2*a* is an example of the directional coupler 2 mounted in a metal cap type package, and the metal cap 26 is an example of a conductor shield.

The metal cap 26 is formed of, for example, nickel silver. The metal cap 26 is fixed to a cutout portion (not illustrated) which is provided on the side surface of the dielectric substrate 24 and to which through-hole plating is applied, using a conductive bonding material such as solder or the like, and functions as a shield.

The directional coupler 2*b* illustrated in FIG. 2C further includes a mold layer 27 covering the main line 21, the sub line 22, and the dielectric layer 23. The mold layer 27 is formed of a polyimide-based thermosetting resin, for example, and is arranged on the dielectric substrate 24. The relative dielectric constant of the dielectric layer 23 and the relative dielectric constant of the mold layer 27 are different from each other. The mold layer 27 may be provided so as to have the same outer shape as that of the dielectric substrate 24 in a plan view. The directional coupler 2*b* is an example of the directional coupler 2 mounted in a mold type package.

A metal film 28 may be formed on the surface of the mold layer 27. The metal film 28 is a thin film formed of, for example, one or more metals selected from titanium, copper, and nickel, or an alloy thereof, and may be film-formed on the surface of the mold layer 27 by sputtering. The metal film 28 is film-formed from the surface of the mold layer 27 to the side surface of the dielectric substrate 24, is connected to a ground electrode at the side surface of the dielectric substrate 24 (not illustrated), for example, and functions as a shield.

In the directional couplers 2, 2*a*, and 2*b* as well, the dielectric substrate 24 has the first portion A which is in contact with the main line 21, and the second portion B which is in contact with the sub line 22. Furthermore, when the directional couplers 2, 2*a*, and 2*b* are viewed in a plan view, between the first portion A and the second portion B, the third portion C is located in which the relative dielectric constant is changed along a direction intersecting with the main line 21 and the sub line 22.

Specifically, in the directional coupler 2*a*, the relative dielectric constant of the space 25 (the relative dielectric constant of the air present in the space 25) and the relative dielectric constant of the dielectric layer 23 are different from each other. Additionally, in the directional coupler 2*b*, the relative dielectric constant of the mold layer 27 and the relative dielectric constant of the dielectric layer 23 are different from each other. With this configuration, the relative dielectric constant in the third portion C is changed, toward the sub line 22 from the main line 21, from the relative dielectric constant in the first portion A to the relative dielectric constant in the second portion B. Accordingly, in the directional couplers 2, 2*a*, and 2*b* as well, by adjusting the position of the third portion C, the degree of coupling and directivity of the directional couplers 2, 2*a*, and 2*b* can be adjusted.

Furthermore, according to the directional couplers 2, 2*a*, and 2*b*, by providing the main line 21 on the dielectric substrate 24, the loss of the main line 21 can be reduced. Specifically, the main line 21 is not covered with the dielectric layer 23, by a low dielectric loss tangent material constituting the dielectric substrate 24 and a wide line width with a low effective dielectric constant, the loss of the main line 21 is reduced.

Furthermore, according to the directional couplers 2, 2*a*, and 2*b*, since forming the dielectric layer 23 after forming the main line 21 and the sub line 22 makes it possible to adjust the position of the third portion C and adjust the electric field distribution between the main line 21 and the sub line 22, it is possible to easily correct the deviation of the degree of coupling and directivity due to the variation in the mass production of the directional coupler without re-forming the dielectric substrate 24.

Third Embodiment

A directional coupler according to a third embodiment will be described.

Figure 3:
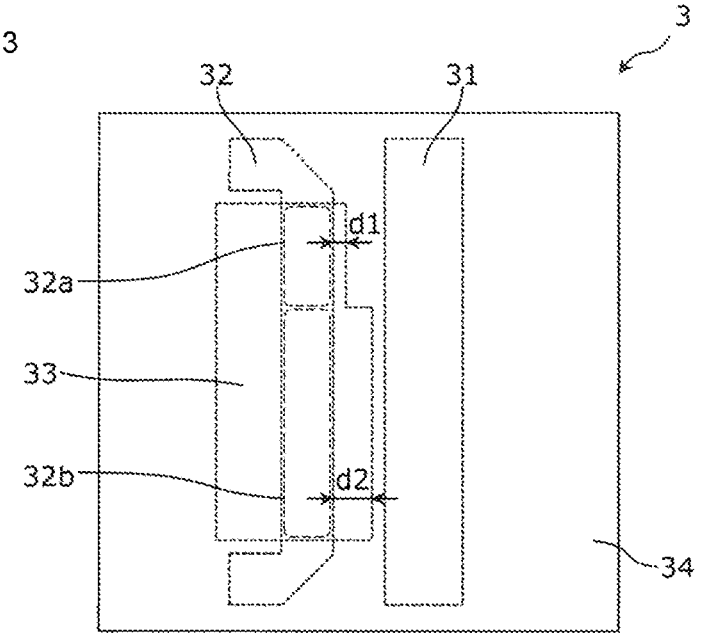
FIG. 3 is a top view illustrating an example of a structure of a directional coupler according to a third embodiment.

FIG. 3 is a top view illustrating an example of a structure of the directional coupler according to the third embodiment.

As illustrated in FIG. 3, a directional coupler 3 includes a dielectric substrate 34 on which a main line 31 and a sub line 32 are formed, and a dielectric layer 33 arranged on the dielectric substrate 34 and covering only the sub line 32 among the main line 31 and the sub line 32.

The main line 31, the sub line 32, the dielectric layer 33, and the dielectric substrate 34 of the directional coupler 3 correspond to the main line 21, the sub line 22, the dielectric layer 23, and the dielectric substrate 24 of the directional coupler 2 described in the second embodiment, respectively. The directional coupler 3 is, in comparison with the directional coupler 2 in FIG. 2A, identical thereto in materials forming the corresponding elements, and is different therefrom in the arrangement of the main line 31 and the sub line 32 and the shape of the dielectric layer 33.

Specifically, in the directional coupler 3, distances d1 and d2 from the sub line 32 to the end portion of the dielectric layer 33 between the main line 31 and the sub line 32 are different from each other in two portions 32*a* and 32*b* in the lengthwise direction of the sub line 32. Here, the distance from the sub line 32 to the end portion of the dielectric layer 33 means the shortest distance from the end portion of the sub line 32 to the end portion of the dielectric layer 33, and means, in a section in which the end portion of the sub line 32 and the end portion of the dielectric layer 33 are represented by substantially parallel line segments, an interval between the line segments.

In the two portions 32*a* and 32*b* of the sub line 32, in accordance with the distances d1 and d2 from the sub line 32 to the end portion of the dielectric layer 33 between the main line 31 and the sub line 32, the electric field distributions between the main line 31 and the sub line 32 are different from each other. By utilizing properties that the electric field distribution between the main line 31 and the sub line 32 affects the degree of coupling and directivity of the directional coupler 3, the degree of coupling and directivity can be optimized by adjusting the distances d1 and d2.

In the example of FIG. 3, in the portion 32*a* of the sub line 32, the end portion of the dielectric layer 33 is processed into a shape shifted toward the sub line 32. In this portion, the electric field distribution is weakened and the electric field coupling decreases between the main line 31 and the sub line 32, whereby the directivity of the directional coupler 3 is adjusted. Even if the directivity is adjusted in this manner, the effective relative dielectric constants of the dielectric layer 33 and the dielectric substrate 34 which are in contact with the sub line 32 do not largely change in the entire sub line 32 including the portion 32*a*. Accordingly, it is not necessary to change the line width and the line length of the sub line 32, and it is possible to adjust only the directivity in actual.

Note that the dielectric layer 33 may be formed in a desired shape by photolithography or ink jet printing, or after the dielectric layer 33 is formed, the undesired portion may be removed by Leutor or a laser beam.

Fourth Embodiment

A directional coupler according to a fourth embodiment will be described.

Figure 4:
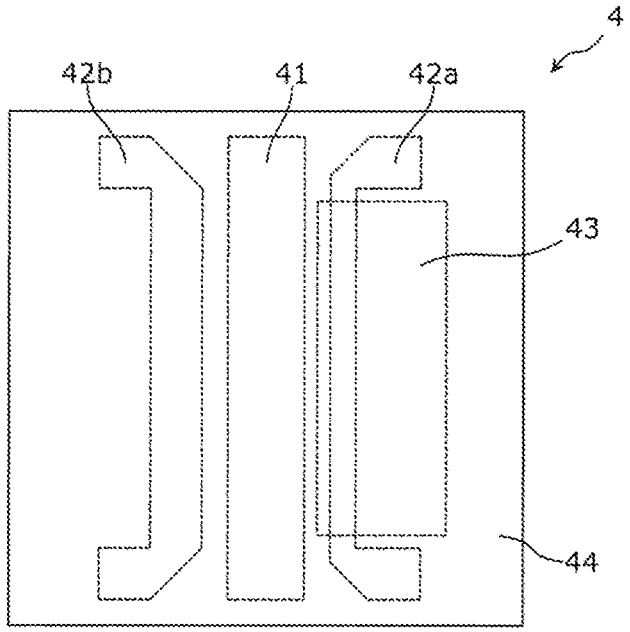
FIG. 4 is a top view illustrating an example of a structure of a directional coupler according to a fourth embodiment.

FIG. 4 is a top view illustrating an example of a structure of the directional coupler according to the fourth embodiment.

As illustrated in FIG. 4, a directional coupler 4 includes a dielectric substrate 44 on which a main line 41 and sub lines 42*a* and 42*b* are formed, and a dielectric layer 43 arranged on the dielectric substrate 44 and covering only the sub line 42*a* among the main line 41 and the sub lines 42*a* and 42*b*. In the directional coupler 4, the sub lines 42*a* and 42*b* are formed on the opposite sides to each other with the main line 41 interposed therebetween.

The main line 41, the sub lines 42*a* and 42*b*, the dielectric layer 43, and the dielectric substrate 44 of the directional coupler 4 correspond to the main line 21, the sub line 22, the dielectric layer 23, and the dielectric substrate 24 of the directional coupler 2 described in the second embodiment, respectively. The directional coupler 4 is, in comparison with the directional coupler 2 in FIG. 2A, identical thereto in materials forming the corresponding elements, and is different therefrom in that the sub line 42*a* which is covered and the sub line 42*b* which is not covered, by the dielectric layer 43, are included.

In the example illustrated in FIG. 4, because of wave length shortening effect and increase in distribution capacitance by the high relative dielectric constant of the dielectric layer 43, the sub line 42*a* covered with the dielectric layer 43 has an increased electric length and a reduced line width. As a result, the sub line 42*a* is optimized for the detection of a lower frequency signal in comparison with the sub line 42*b* having the same physical line length. Increase in loss due to the dielectric loss tangent of the dielectric layer 43 and increase in loss derived from copper loss due to line-thinning can be counted in part of a coupling coefficient and are not disadvantageous.

Furthermore, in the example illustrated in FIG. 4, the sub lines 42*a* and 42*b* are formed on the opposite sides to each other with the main line 41 interposed therebetween. With this configuration, compared to a case where both of the sub lines 42*a* and 42*b* are located on the same side (the left side or the right side of the main line 41 when viewed in a plan view) with respect to the main line 41, the degree of coupling between the sub line 42*a* and the main line 41 and the degree of coupling between the sub line 42*b* and the main line 41 can both be favorably maintained.

For example, when both of the sub lines 42*a* and 42*b* are arranged on the same side with respect to the main line 41, the degree of coupling between the sub line arranged on the side farther from the main line 41 of the sub lines 42*a* and 42*b* and the main line becomes much smaller than the degree of coupling between the sub line arranged on the side closer to the main line 41 and the main line.

In contrast, when the sub lines 42*a* and 42*b* are arranged on the opposite sides to each other with the main line 41 interposed therebetween, both the sub lines 42*a* and 42*b* are easy to be arranged close to the main line 41, which makes it easy to favorably maintain both the degree of coupling between the sub line 42*a* and the main line 41 and the degree of coupling between the sub line 42*b* and the main line 41.

Fifth Embodiment

A directional coupler according to a fifth embodiment will be described.

Figure 5A:
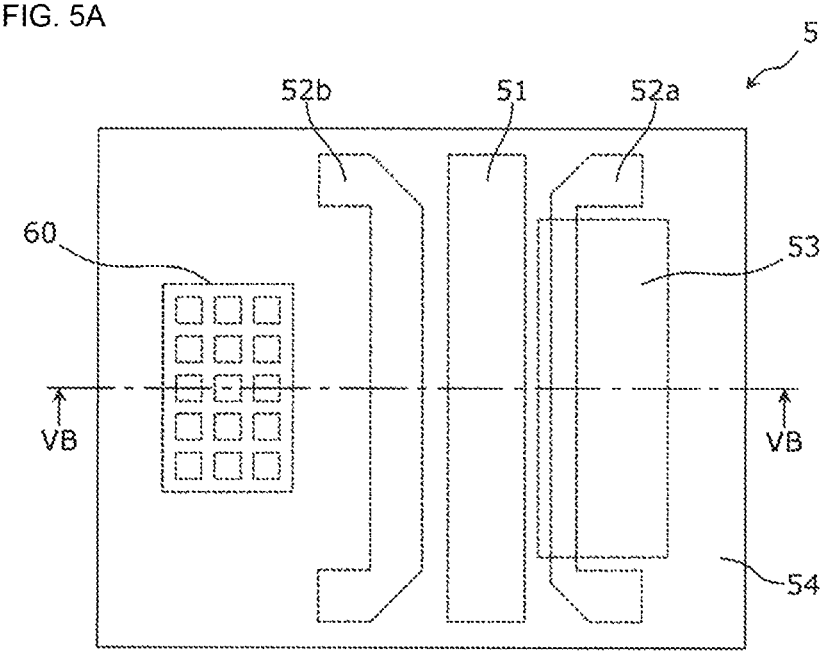
FIG. 5A is a top view illustrating an example of a structure of a directional coupler according to a fifth embodiment.

FIG. 5A is a top view illustrating an example of a structure of the directional coupler according to the fifth embodiment.

Figure 5B:
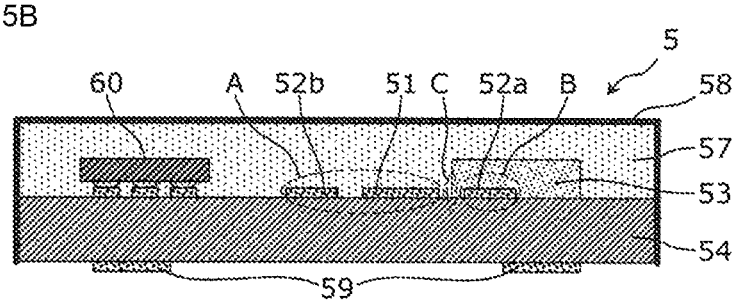
FIG. 5B is a side view illustrating the example of the structure of the directional coupler according to the fifth embodiment.

FIG. 5A and FIG. 5B are a top view and a side view, respectively, illustrating an example of the structure of the directional coupler according to the fifth embodiment. FIG. 5B corresponds to a cross section indicated by the VB-VB line in FIG. 5A.

As illustrated in FIG. 5A and FIG. 5B, a directional coupler 5 includes a dielectric substrate 54 on which a main line 51 and sub lines 52*a* and 52*b* are formed, and a dielectric layer 53 arranged on the dielectric substrate 54 and covering only the sub line 52*a* among the main line 51 and the sub lines 52*a* and 52*b*. Additionally, the directional coupler 5 includes a semiconductor chip 60 in which various functional circuits are formed, a mold layer 57 which covers the main line 51, the sub lines 52*a* and 52*b*, the dielectric layer 53, and the semiconductor chip 60, and external connection terminals 59. A metal film 58 may be formed on the surface of the mold layer 57.

The main line 51, the sub lines 52*a* and 52*b*, the dielectric layer 53, and the dielectric substrate 54 of the directional coupler 5 correspond to the main line 41, the sub lines 42*a* and 42*b*, the dielectric layer 43, and the dielectric substrate 44 of the directional coupler 4 described in the fourth embodiment, respectively. Furthermore, the mold layer 57, the metal film 58, and the external connection terminal 59 of the directional coupler 5 correspond to the mold layer 27, the metal film 28, and the external connection terminal 29 of the directional coupler 2*b* described in the second embodiment, respectively.

The semiconductor chip 60 may be a chip size package which is flip-chip mounted on the dielectric substrate 54, and a space between the semiconductor chip 60 and the dielectric substrate 54 may be filled with an underfill resin (not illustrated).

In the semiconductor chip 60, for example, a switch circuit for switching a detection direction of the main signal and various variable impedance circuits for adjusting the characteristics of the directional coupler are formed.

Figure 6:
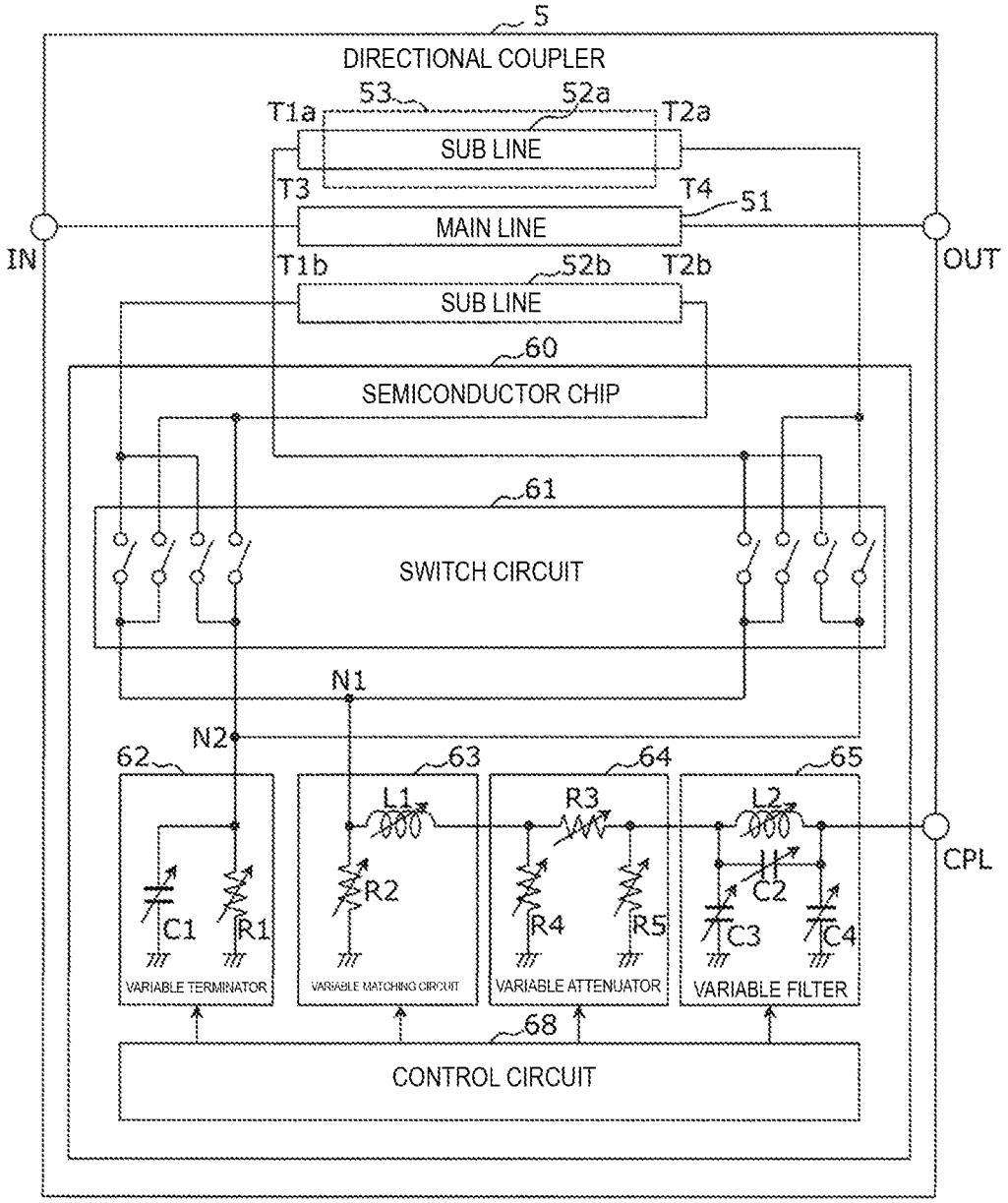
FIG. 6 is a circuit diagram illustrating an example of a functional configuration of the directional coupler according to the fifth embodiment.

FIG. 6 is a circuit diagram illustrating an example of a functional configuration of the directional coupler 5. In FIG. 6, together with the main line 51 and the sub lines 52*a* and 52*b*, a switch circuit 61, a variable terminator 62, a variable matching circuit 63, a variable attenuator 64, a variable filter 65, and a control circuit 68, which are functional circuits formed in the semiconductor chip 60, are illustrated.

Furthermore, an input port IN and an output port OUT respectively connected to the first end portion T3 and the second end portion T4 of the main line 51, and a coupling port CPL for outputting a detection signal are illustrated. The input port IN, the output port OUT, and the coupling port CPL are each constituted of the external connection terminal 59.

The switch circuit 61 switches four states of (1) a state in which, of the sub line 52*a*, a first end portion T1*a* is connected to a first node N1 and a second end portion T2*a* is connected to a second node N2, (2) a state in which, of the sub line 52*a*, the first end portion T1*a* is connected to the second node N2 and the second end portion T2*a* is connected to the first node N1, (3) a state in which, of the sub line 52*b*, a first end portion T1*b* is connected to the first node N1 and a second end portion T2*b* is connected to the second node N2, and (4) a state in which, of the sub line 52*b*, the first end portion T1*b* is connected to the second node N2 and the second end portion T2*b* is connected to the first node N1.

With this configuration, the switch circuit 61 functions as a first switch circuit for switching which sub line of the sub lines 52*a* and 52*b* is used as a sub line connected to the first node N1 and the second node N2. At the same time, the switch circuit 61 functions, at the sub line to be used, as a second switch circuit for switching whether to connect the first end portion to the first node N1 and connect the second end portion to the second node N2, or to connect the first end portion to the second node N2 and connect the first end portion to the first node N1. Here, the first node N1 is a node for outputting a detection signal, and the second node N2 is a node for termination.

The control circuit 68 receives a data signal indicating the state of each switch included in the switch circuit 61 (not illustrated), and switches each switch included in the switch circuit 61 to a state indicated by the received data signal.

According to the directional coupler 5, in accordance with the switching of the switch circuit 61, even if the detection signal is for a main signal propagating in the main line 51 in the forward direction or in the reverse direction, the detection signal can be guided to the first node N1 for outputting the detection signal.

The variable terminator 62 is a terminating circuit in which resistance and reactance can be adjusted for terminating the end portions for the termination of the sub lines 52*a* and 52*b*, and is mainly used for optimizing the directivity of the directional coupler 5. The variable terminator 62 is constituted of, for example, a circuit in which a variable capacitor C1 and a variable resistance R1 are connected in parallel, and is connected between the second node N2 and the ground.

The variable matching circuit 63 is a circuit for bringing impedance at the end portion for signal output of the sub lines 52*a* and 52*b* close to a reference impedance (so-called characteristic impedance) of the circuit, and is mainly used for optimizing the directivity of the directional coupler 5. The variable matching circuit 63 is provided, for example, in a signal path connecting the first node N1 and the coupling port CPL, and includes a variable inductor L1 constituting a part of the signal path, and a variable resistance R2 connected between one end of the variable inductor L1 and the ground.

The variable attenuator 64 is a circuit for adjusting the passing loss of the detection signal obtained from the end portion for signal output of the sub lines 52*a* and 52*b*, and is mainly used for optimizing the degree of coupling of the directional coupler 5. The variable attenuator 64 is provided, for example, in a signal path connecting the first node N1 and the coupling port CPL, and includes a variable resistance R3 constituting part of the signal path, a variable resistance R4 connected between one end of the variable resistance R3 and the ground, and a variable resistance R5 connected between the other end of the variable resistance R3 and the ground.

The variable filter 65 is a circuit for adjusting the frequency characteristics of the detection signal obtained from the end portion for signal output of the sub lines 52*a* and 52*b*, and is mainly used for optimizing the frequency characteristics of the degree of coupling of the directional coupler 5. The variable filter 65 is provided, for example, in a signal path connecting the first node N1 and the coupling port CPL, and includes a variable inductor L2 constituting a part of the signal path, a variable capacitor C2 connected in parallel to the variable inductor L2, a variable capacitor C3 connected between one end of the variable inductor L2 and the ground, and a variable capacitor C4 connected between the other end of the variable inductor L2 and the ground.

The variable inductor, the variable capacitor, and the variable resistance used for these variable elements are obtained as described below as an example.

Figure 7A:
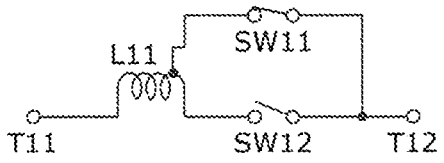
FIG. 7A is a circuit diagram illustrating an example of a configuration of a variable inductor according to the fifth embodiment.
Figure 7B:
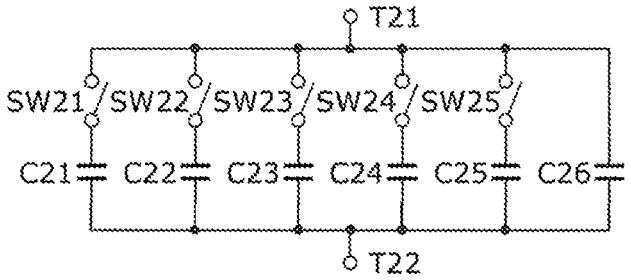
FIG. 7B is a circuit diagram illustrating an example of a configuration of a variable capacitor according to the fifth embodiment.
Figure 7C:
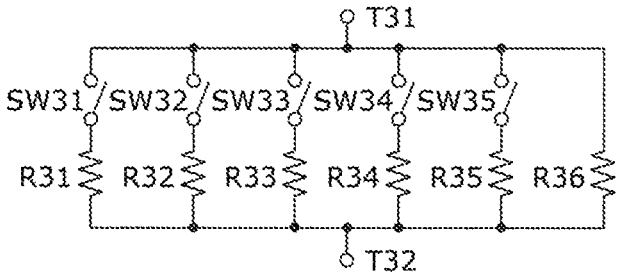
FIG. 7C is a circuit diagram illustrating an example of a configuration of a variable resistance according to the fifth embodiment.

FIG. 7A, FIG. 7B, and FIG. 7C are circuit diagrams illustrating examples of the configurations of a variable inductor, a variable capacitor, and a variable resistance, respectively. The variable inductor, the variable capacitor, and the variable resistance illustrated in FIG. 7A, FIG. 7B, and FIG. 7C are all obtained by selecting a plurality of elements or a portion of an element having a fixed constant using the switch.

According to the variable terminator 62, the variable matching circuit 63, the variable attenuator 64, and the variable filter 65 using the variable inductor, the variable capacitor, and the variable resistance, which are obtained as described above, it is possible to change the circuit constant with ease in accordance with control by the control circuit 68.

According to the directional coupler 5, in addition to adjusting the electric field distribution between the main line and the sub line in accordance with the position of the boundary point of the material constant in the dielectric in which the main line and the sub lines are arranged, changing the circuit constants of the variable terminator 62, the variable matching circuit 63, the variable attenuator 64, and the variable filter 65 also makes it possible to adjust the degree of coupling and directivity of the directional coupler 5. This further improves the degree of freedom in the adjustment of the degree of coupling and directivity, and makes it possible to obtain the directional coupler in which the degree of coupling and directivity can be more precisely adjusted.

According to a directional coupler according to the present disclosure, by using a third portion in which a relative dielectric constant is changed between a main line and a sub line, by adjusting electric field distribution between the main line and the sub line, it is possible to adjust the degree of coupling and directivity of the directional coupler.

With this configuration, in the adjustment of the degree of coupling and directivity, since the distance between the main line and the sub line and the width of each line are not changed, the influence on characteristics, such as the impedance or the like of the main line and the sub line, other than the degree of coupling and directivity, decreases. As a result, since the degree of freedom in the adjustment of the degree of coupling and directivity is improved, the degree of coupling and directivity can be more precisely adjusted. For characteristics other than the degree of coupling and directivity as well, by being independent of the adjustment of the degree of coupling and directivity, the degree of freedom in design for obtaining desired characteristics is improved.

Although the directional coupler according to the present disclosure has been described above based on the embodiments, the present disclosure is not limited to the individual embodiments. Variations on the present embodiment conceived of by those skilled in the art, and embodiments created by combining constituent elements from different embodiments may be included in the scope of one or more aspects of the present disclosure as long as they do not depart from the essential spirit of the present disclosure.

The present disclosure can be widely used in wireless equipment such as a portable terminal device, as a directional coupler in which the degree of coupling and directivity can be more precisely adjusted.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A directional coupler comprising:

a dielectric having a first main surface and a second main surface facing each other;

a main line provided on a side of the first main surface in contact with the dielectric; and a sub line provided on the side of the first main surface in contact with the dielectric, wherein the dielectric has a first portion in contact with the main line and a second portion in contact with the sub line, and when the first main surface is viewed in a plan view, between the first portion and the second portion, a third portion having a relative dielectric constant changing along a direction intersecting with the main line and the sub line is located, such that a relative dielectric constant of the first portion and a relative dielectric constant of the second portion are different from each other.

2. The directional coupler according to claim 1, further comprising:

a second switch circuit for switching whether to connect a first end portion of the sub line to a first node for outputting a detection signal and connect a second end portion of the sub line to a second node for termination, or to connect the first end portion of the sub line to the second node and connect the second end portion to the first node.

3. The directional coupler according to claim 1, further comprising:

a variable terminator connected between at least one end portion of the sub line and a ground electrode.

4. The directional coupler according to claim 1, further comprising:

a variable matching circuit connected to a signal path connecting at least one end portion of the sub line and a coupling port.

5. The directional coupler according to claim 1, further comprising:

a variable attenuator connected to a signal path connecting at least one end portion of the sub line and a coupling port.

6. The directional coupler according to claim 1, further comprising:

a variable filter connected to a signal path connecting at least one end portion of the sub line and a coupling port.

7. The directional coupler according to claim 1, the dielectric being a dielectric substrate, the directional coupler further comprising:

a dielectric layer arranged on the dielectric substrate and covering at least a part of only the sub line among the main line and the sub line; and a mold layer arranged on the dielectric substrate and covering the main line and the dielectric layer, wherein a relative dielectric constant of the dielectric layer and a relative dielectric constant of the mold layer are different from each other.

8. The directional coupler according to claim 7, further comprising:

a metal film provided on a surface of the mold layer.

9. The directional coupler according to claim 7, wherein distances from the sub line to an end portion of the dielectric layer between the main line and the sub line are different from each other in two portions in a lengthwise direction of the sub line.

10. The directional coupler according to claim 1, the dielectric being a dielectric substrate, the directional coupler further comprising:

a dielectric layer arranged on the dielectric substrate and covering at least a part of only the sub line among the main line and the sub line; and a conductor shield film covering the dielectric substrate and providing a space for housing at least the main line, wherein the main line is exposed in the space.

11. The directional coupler according to claim 10, wherein distances from the sub line to an end portion of the dielectric layer between the main line and the sub line are different from each other in two portions in a lengthwise direction of the sub line.

12. The directional coupler according to claim 10, wherein the sub line includes a first sub line and a second sub line, the dielectric layer covers at least a part of only one sub line among the first sub line and the second sub line.

13. The directional coupler according to claim 12, wherein the first sub line and the second sub line are arranged on opposite sides to each other across the main line when viewed in a plan view.

14. The directional coupler according to claim 12, further comprising:

a first switch circuit for switching whether the first sub line is used as the sub line or the second sub line is used as the sub line.

* * * * *